US005637434A

United States Patent [19]

Ikushima et al.

[11] Patent Number: 5,637,434

[45] Date of Patent: Jun. 10, 1997

[54] METHOD FOR PRODUCING TONER FOR ELECTROSTATIC DEVELOPMENT

[75] Inventors: Susumi Ikushima; Shingo Ishiyama; Sadaki Yagi; Hideaki Uchida, all of Joetsu, Japan

[73] Assignee: Mitsubishi Chemical Corporation, Tokyo, Japan

[21] Appl. No.: 468,320

[22] Filed: Jun. 6, 1995

Related U.S. Application Data

[63] Continuation-in-part of Ser. No. 169,077, Dec. 20, 1993, abandoned.

[30] Foreign Application Priority Data

Dec. 21, 1992 [JP] Japan ..... 4-356317
Mar. 15, 1993 [JP] Japan ..... 5-54094

[51] Int. Cl.[6] ..... G03G 9/08

[52] U.S. Cl. ..... 430/137; 241/24.28

[58] Field of Search ..... 430/137; 241/24.27, 241/24.28, 25, 27

[56] References Cited

U.S. PATENT DOCUMENTS

| | | |
|---|---|---|
| 3,464,636 | 9/1969 | Byers . |
| 4,562,972 | 1/1986 | Hagiwara et al. . |
| 4,839,255 | 6/1989 | Hyosu et al. . |
| 5,223,365 | 6/1993 | Yamamoto et al. . |
| 5,269,471 | 12/1993 | Yamagishi . |

FOREIGN PATENT DOCUMENTS

| | | |
|---|---|---|
| 0 122 608 | 10/1984 | European Pat. Off. . |
| 0 492 529 | 7/1992 | European Pat. Off. . |
| 0 509 464 | 10/1992 | European Pat. Off. . |
| 93 06 900 | 9/1992 | Germany . |
| 58-42057 | 3/1983 | Japan . |
| 59-105853 | 6/1984 | Japan . |
| 59-127651 | 7/1984 | Japan . |
| 59-189944 | 10/1984 | Japan . |
| 59-196751 | 11/1984 | Japan . |
| 63-104658 | 5/1988 | Japan . |
| 5-269393 | 10/1993 | Japan . |

OTHER PUBLICATIONS

Diamond, Arthur S. (editor) Handbook of Imaging Materials. New York: Marcel–Dekker, Inc., pp. 193–196. 1991.

Webster's II New Riverside Dictionary. The Riverside Publishing Company, p. 293. 1984.

*Primary Examiner*—Christopher D. Rodee

*Attorney, Agent, or Firm*—Oblon, Spivak, McClelland, Maier & Neustadt, P.C.

[57] ABSTRACT

In a method for producing a toner for electrostatic development, a mixture of starting toner materials comprising at least a resin and a colorant is kneaded, extruded and cooled to obtain a toner material. The toner material is crushed and then pulverized by an impact pulverizer having a pulverizing section formed by disposing a stator having ridges of a triangular waveform at an inner surface thereof and a rotor having ridges of a triangular waveform at an outer surface thereof at a gap between the ridges of the stator and of the rotor.

11 Claims, 2 Drawing Sheets

METHOD FOR PRODUCING TONER FOR ELECTROSTATIC DEVELOPMENT

CROSS REFERENCE TO RELATED APPLICATION

This is a continuation-in-part of application Ser. No. 08/169,077, filed Dec. 20, 1993 now abandoned.

BACKGROUND OF THE INVENTION

The present invention relates to a method for producing a toner for electrostatic image development and, more specifically, it relates to an economically advantageous method for producing a toner for electrostatic image development, causing less fogging and capable of providing a satisfactory image quality.

A toner for electrostatic image development (hereinafter simply referred to as "toner") comprises resin particles having particle size of 1 to 50 μm, preferably, an average classified diameter of 3 to 15 μm in which a colorant and, if required, toner property-imparting agents (for example, a charge controlling agent and magnetic particles) are dispersed in a thermoplastic resin as a binder resin. The toner is used as a one-component developer containing the toner alone or as a two-component developer containing a mixture of the toner with a carrier.

Generally, the toner is produced by mixing starting toner materials, kneading them in a melt extruder or the like and then cooling and grinding them. In production of the toner, the grinding process is a particularly important step for giving an influence on the characteristics of the toner. Namely, an excessively ground toner causes fogging, whereas an insufficiently ground toner deteriorates image quality.

The grinding process for producing the toner usually comprises three steps, namely, coarse crushing step, medium crushing step and fine pulverizing step. Such grinding process is proposed, for example, in Japanese Patent Application Laid-Open (Kokai) No. 58-42057 (1983). In the grinding process as described in the publication, a toner material extruded from a melt extruder into a plate shape and then cooled to solidify is at first crushed by a hammer crusher, then crushed to a medium size by an impact crusher and then further pulverized finely by a jet pulverizer. Subsequently, a classifying treatment is applied to recover a toner.

However, since the grinding process described above consumes much energy in the medium crushing step and the fine pulverizing step, it can not be considered as an economically advantageous method. Further, in the pulverization using the jet pulverizer, an over-pulverized toner is formed by as much as 15 to 40% by weight and, accordingly, the over-pulverized toner tends to intrude into final toner products and the productivity becomes poor because the over-pulverized toner has to be removed and, in addition, an additional energy is required for re-using the over-pulverized toner once removed.

In view of the above, the present inventors have found that by using a specific pulverizer, a toner for electrostatic charge development, causing less fogging and capable of providing satisfactory image quality can be produced with less occurrence of over-pulverized toner, at a satisfactory productivity and with an economical advantage. The present invention has been accomplished based on the finding.

SUMMARY OF THE INVENTION

In a first aspect of the present invention, there is provided a method for producing a toner for electrostatic development, comprising crushing a toner material obtained by melting, kneading and cooling starting toner materials comprising at least a resin and a colorant, and then pulverizing the crushed toner material by an impact pulverizer having a pulverizing section formed by disposing a stator having ridges of a triangular waveform at an inner surface thereof and a rotor having ridges of a triangular waveform at an outer surface thereof at a gap between the ridges of the stator and of the rotor.

DETAILED DESCRIPTION OF THE INVENTION

Figure 1:
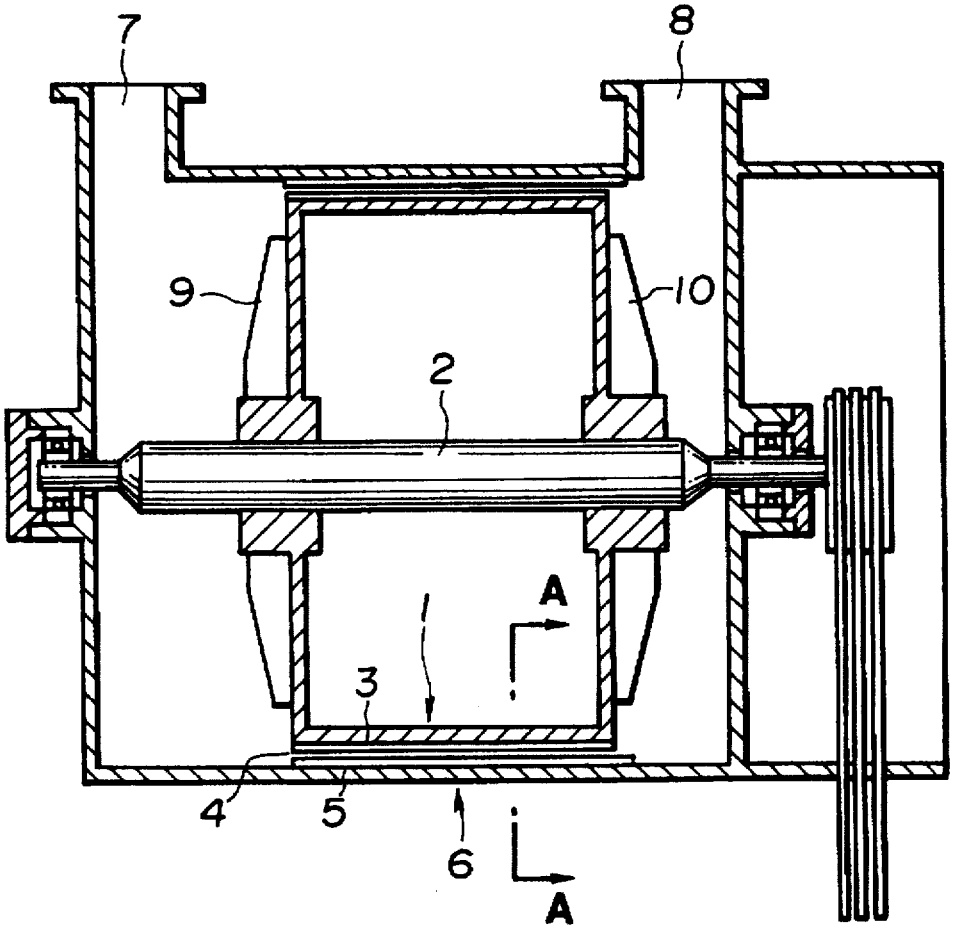
FIG. 1 is a cross sectional view for an embodiment of an impact pulverizer according to the present invention.

In the present invention, starting toner materials are generally at first mixed, kneaded and extruded into a plate shape or the like, for example, in a melt extruder and then cooled to solidify. As the starting toner materials, at least a binder resin and a colorant are used as essential ingredients and, if necessary, a charge controlling agent or the like may also be used.

As the resin, various kinds of known resins suitable to the toner can be used. There can be mentioned, for example, styrene resins, vinyl chloride resins, rosin-modified maleic acid resins, phenol resins, epoxy resins, polyesters, polyethylenes, polypropylenes, ionomer resins, polyurethanes, silicone resins, ketone resins, ethylene-ethyl acrylate resins, xylene resins, polyvinyl butyral resins and polycarbonate resins.

The styrene resin is a homopolymer or a copolymer including styrene or substituted styrenes. Specifically, there can be mentioned polystyrene, chloropolystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-acrylic acid ester copolymer (for example, styrene-methyl acrylate copolymer, styrene-ethyl acrylate copolymer, styrene-butyl acrylate copolymer, styrene-octyl acrylate copolymer and styrene-phenyl acrylate copolymer), styrene methacrylic acid ester copolymer (for example, styrene-methyl methacrylate copolymer, styrene-ethyl methacrylate copolymer, styrene-butyl methacrylate copolymer, styrene-octyl methacrylate copolymer and styrene-phenyl methacrylate copolymer), styrene-α-methyl chloroacrylate and styrene-acrylonitrile-acrylate copolymer.

Among the resins described above, particularly, styrene resins, saturated or unsaturated polyesters and epoxy resins are usually used. Further, cross-linked binder resins as described in Japanese Patent Publication (Kokoku) No. 51-23354 (1976) and Japanese Patent Application Laid-Open (Kokai) No. 50-44836 (1975) and non-cross-linked binder resins as described in Japanese Patent Publication (Kokoku) No. 55-6895 (1980) and Japanese Patent Publication (Kokoku) No. 63-32180 (1988) can also be used. Two or more of such resins may be used in combination.

As the colorant, for example, carbon black, nigrosines, benzidine yellow, quinacridone, rhodamine B and phthalocyanine blue can be used suitably. The colorant is used usually from 0.1 to 30 parts by weight and, preferably, 3 to 15 parts by weight based on 100 parts by weight of the resin.

As the charge controlling agent, there can be mentioned a positive charge controlling agent, for example, a quaternary ammonium salt, a nigrosine dye, a triphenyl methane dye, styrene-aminoacrylate copolymer and a polyamine resin, and a negative charge controlling agent such as a monoazo metal complex salt. The charge controlling agent is used preferably from 0.1 to 10 parts by weight based on 100 parts by weight of the resin.

Further, in the present invention, various kinds of toner property-imparting agents can also be used. For instance, polyethylene wax or polypropylene wax can be used for preventing offset. Further, inorganic fine particles, for example, of titania, alumina and silica can be used for improvement of the flowability and anti-coagulation property. The toner property-imparting agent can be used preferably from 0.1 to 10 parts by weight based on 100 parts by weight of the resin.

Moreover, additives such as magnetic particles can be added as necessary. As the magnetic particles, alloys or compounds containing ferromagnetic elements such as iron, cobalt and nickel, for example, ferrites and magnetites can be mentioned. The magnetic particles are used at a ratio usually from 20 to 70 parts by weight based on 100 parts by weight of the resin.

Then, in the present invention, the cooled and solidified toner material is ground. The grinding process according to the present invention comprises at least two steps. In the first grinding step, the toner material is crushed by a coarse crusher such as a hammer crusher. The degree of the crushing is suitably within a range from 100 to 1000 μm expressed as a weight average particle diameter. The weight average particle diameter is a median particle diameter of particle diameter-weight distribution, which can be measured, for example, Coulter counter manufactured Coulter Electronics Co. The main feature of the present invention lies in the second grinding step in which the crushed toner material is pulverized by an impact pulverizer having a specific pulverizing section.

Heretofore, several pulverizers have been proposed as a pulverizer capable of finely pulverizing an usual solid material into fine particles of from several microns to several tens micron order. For instance, Japanese Patent Application Laid-Open (Kokai) No. 59-105853 (1984) proposes a vertical pulverizer capable of pulverizing an usual solid material into fine particles of from several microns to ten and several microns order, having a pulverizing section in which a stator having a plurality of ridges of a triangular waveform on an inner surface and a rotor having a plurality of ridges of a rectangular convex shape on an outer surface are disposed at a gap. Also, the above mentioned publication describes, as a prior art, a pulverizer in which both of ridges of the stator and the rotor are in a rectangular convex shape, and a vertical pulverizer in which the ridges of the stator are in a rectangular convex shape and the ridges of a rotor is formed by embedding flat plates. The vertical pulverizer having the similar pulverizing section to that described in the above-mentioned laid-open publication is also proposed by Japanese Patent Application Laid-Open (Kokai) Nos. 59189944 (1984) and 59-196751 (1984).

Further, Japanese Patent Application Laid-Open (Kokai) No. 59-127651 (1984) proposes, as a pulverizer capable of easily pulverizing fibrous plant or vegetable substance such as wood dust or saw dust or soft material such as rubber into a size of several tens micron order, a vertical pulverizer having a pulverizing section in which a stator having a plurality of ridges each having a pulverizing blade of an extremely acute angle at an inner surface and a rotor having a plurality of ridges each having a pulverizing blade of an extremely acute angle at an outer surface are disposed at a gap. A triangular waveform and an inverted trapezoidal shape have been disclosed as the shape of the ridges.

Further, Japanese Patent Application Laid-Open (Kokai) No. 63-104658 (1988) proposes, as a vertical pulverizer capable of finely pulverizing a usual solid material into fine particles, a vertical pulverizer having a pulverizing section in which ridges of both of a stator and a rotor are formed each in a rectangular convex shape, a pulverizing section in which ridges of a stator are in a rectangular convex shape and ridges of a rotor is formed by embedding flat plates, or a pulverizing section in which both of ridges of a stator and a rotor are in a triangular waveform, in the same manner as proposed in Japanese Patent Application Laid-Open (Kokai) No. 59-105853 (1984) described above.

In the present invention, it is necessary to use a pulverizer (impact pulverizer) having a pulverizing section in which a stator having a plurality of ridges of a triangular waveform on an inner surface and a stator having a plurality of ridges of a triangular waveform on an outer surface are disposed at a gap between the ridges of the stator and of the rotor, which are a similar pulverizing section to that in the pulverizer proposed by Japanese Patent Application Laid-Open (Kokai) No. 59-127651 (1984).

While pulverizing sections having ridges of various shapes have been proposed by laid-open publications described above, it has unexpectedly found according to the present inventors that by using not the pulverizing section in the pulverizer proposed as a pulverizer capable of suitably pulverizing into fine particles from several micron meters to ten and several micron meter order but using a pulverizer having the similar pulverizing section to that in the pulverizer described in Japanese Patent Application Laid-Open (Kokai) No. 59-127651 (1984) which was proposed as a pulverizer suitable to pulverize into several tens micron meter order, a toner causing less fogging and capable of providing a satisfactory image quality can be produced by using only one pulverizing step instead of the medium crushing step and the fine pulverizing step in the conventional method.

Figure 2:
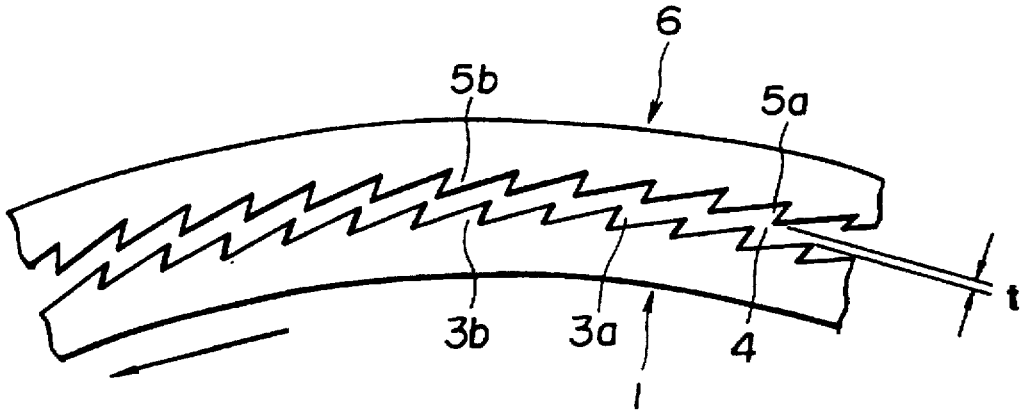
FIG. 2 is a cross sectional view taken along line A—A in FIG. 1.

FIG. 1 is a cross sectional view for an embodiment of an impact pulverizer used in the present invention and FIG. 2 is a cross sectional view taken along line A—A in FIG. 1.

The impact pulverizer used in the present invention is not restricted to the vertical pulverizer as described in Japanese Patent Application Laid-Open (Kokai) No. 59-127651 (1984) but it may be a horizontal one. The horizontal pulverizer basically comprises a pulverizing section 4 formed between a rotor 1 supported by a horizontal rotating shaft 2 and having a plurality of ridges 3 along a generatrices of an outer surface thereof, and a stator 6 fitted at a gap to the rotor and having a plurality of ridges 5 along generatrices of an inner surface thereof. Each of the rotor 1 and the stator 6 usually has a cylindrical shape. A feed opening 7 and a discharge opening 8 are usually disposed, respectively, to an upper left and upper right sections of a casing constituting the stator 6. Further, agitating blades 9 and 10 rotating integral with the rotor 1 at high speed are secured to the right and left sides of the rotor 1, respectively, but the agitating blades may be omitted depending on the case.

In the impact pulverizer used in the present invention, it is important that both of the ridges 5 of the stator 6 and the ridges 3 of the rotor 1 are formed each in a triangular waveform (in the cross section). The triangular waveform ridge 5 can be constituted by forming concaves 5*a* and convexes 5*b* each substantially in a triangular shape successively, while the triangular waveform ridge 3 can be constituted by forming concaves 3*a* and convexes 3*b* successively. There is no particular restriction on details of the triangular waveform and it can be made into the same shape as shown in Japanese Patent Application Laid-Open (Kokai) No. 59-127651 (1984) described above.

Two flanks forming a triangular waveform ridge usually have angles relative to a tangent line of the rotor or stator of 20° to 70° and 45° to 140°, respectively [the latter is larger than the former]. An angle at the top end of a ridge constituted with the two flanks is usually from 30° to 90°. The top end of a ridge may be sharp or blunt. In case of the blunt end, for example, the top end may be truncated to have a flat face, or may be made round. Preferably, the top end has the flat face, and the flat face usually has a width of 0.2 to 1.0 mm. The bottom of the concave between the ridges also may be sharp or blunt. For example, the bottom may have a round shape such as an elliptical shape or a circular shape. Preferably, the round shape is circular, and the circular arc of the round shape usually has a radius of 0.5 to 2.0 mm. An example of a stator having the triangular waveform in which the top end has the flat face and the bottom has the circular shape is described in Japanese Patent Application Laid-Open (KOKAI) No. 5-269393 (1993). Further, the distance from the top end of the convex to the bottom of the concave is usually from 1 to 10 mm and the ridge pitch is usually from 1 to 10 ridges/cm.

The crushed toner material is treated by the above-mentioned pulverizer as described below. The crushed toner material is supplied from the feed opening 2, sent into a pulverizing section 4 by an air stream caused by the rotor 1, pulverized therein and then discharged by an air stream caused by the rotor 1.

Operation conditions for the impact pulverizer are properly selected and an atmospheric temperature is preferably within a range from 30° to 50° C. and a circumferential speed of the rotor 1 is preferably within a range from 100 to 200 m/s. The rotating direction of the rotor 1 is preferably determined in the direction shown by an arrow in FIG. 2, that is, in such a direction that an acutely-sloped flank of each ridge 5 of the stator 6 does not meet against that of each ridge 3 of the rotor 1, in other words in such a direction that an obtuse-sloped flank of the triangular ridge 3 of the rotor 1 leads when the rotor 1 rotates, and faces to that of the triangular ridge 5 of the stator 6. The rotor rotates relatively to the stator and it is not always necessary that the stator is stationary as shown FIG. 1. Further, a gap (t) disposed between the ridges of the rotor 1 and of the stator 6 (gap between the ridge tops of the rotor 1 and the ridge tops of the stator 6) is properly selected, for example, depending on a desired average particle diameter and it is usually from 0.1 to 5 mm, preferably, 0.5 to 5 mm, more preferably, 1.1 to 3 mm, and still more preferably 1.5 to 3 mm.

The toner materials treated in the impact pulverizer described above and discharged from the discharge opening 8 preferably have a weight average particle diameter of 2 to 15 μm. Further, the toner is preferably applied with classifying treatment. Then, only the toner within a range of a desired particle diameter is recovered. The weight average particle diameter of the classified toner is preferably within a range from 3 to 15 μm. There is no particular restriction on the classifying device and various kinds of classifiers, for example, air classifier or multi-divisional classifier utilizing Coanda effect can be adopted. Then, a slight amount of coarse toner can be circulated to and re-crushed in the impact pulverizer described above, while an over-pulverized toner can be circulated to a melt extruder.

In the method for producing the toner according to the present invention, if it is required for a toner of particularly small particle diameter (for example, weight average particle diameter of 2 to 12 μm), it is preferred that the crushed toner material is once pulverized in the upstream portion of the pulverizing section having a larger gap between the ridges of the rotor and of the stator and, subsequently, pulverized in the downstream portion of the pulverizing section with a smaller gap. As an embodiment of the pulverization, there can be mentioned a method of serially connecting two or more impact pulverizers, and setting the gap in the pulverizing section of the impact pulverizer at or after the second stage is made smaller than the gap in the pulverizing section of the impact pulverizer at the first stage. As an another embodiment, there can be mentioned a method of pulverizing by using an impact pulverizer in which the gap in the pulverizing section on the side of the discharge opening is made smaller than the gap in the pulverizing section on the side of the feed opening. As a further preferred embodiment, there can be mentioned a method of pulverizing by an impact pulverizer in which the gap in the pulverizing section is decreased continuously or stepwise from the feed opening to the discharge opening as shown in FIG. 3 and FIG. 4.

Figure 3:
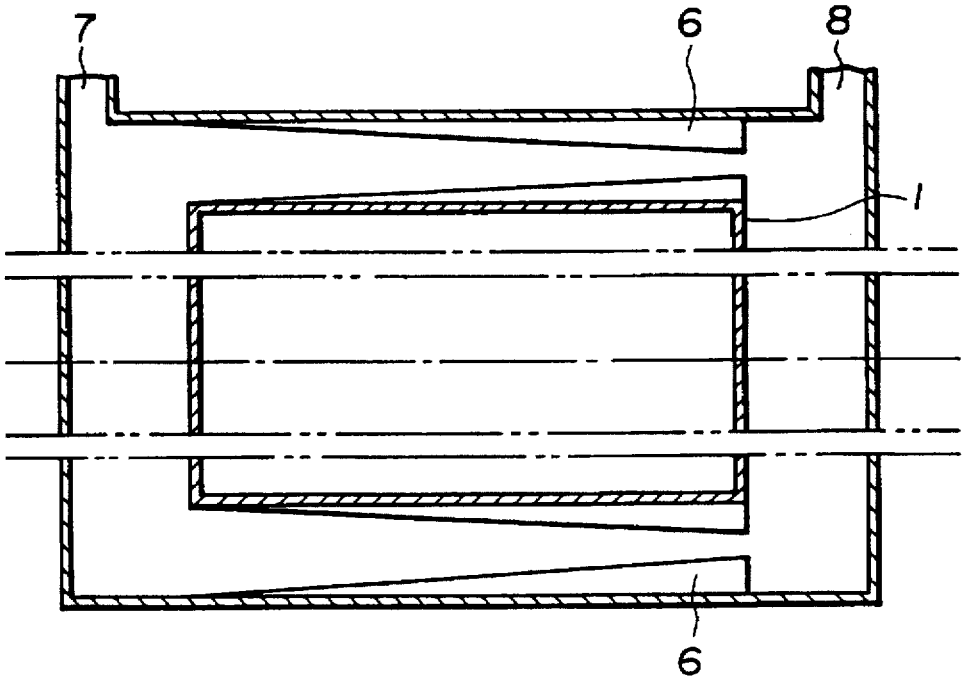
FIG. 3 is a schematic cross sectional view for an embodiment of an impact pulverizer having a tapered rotor and a tapered stator.
Figure 4:
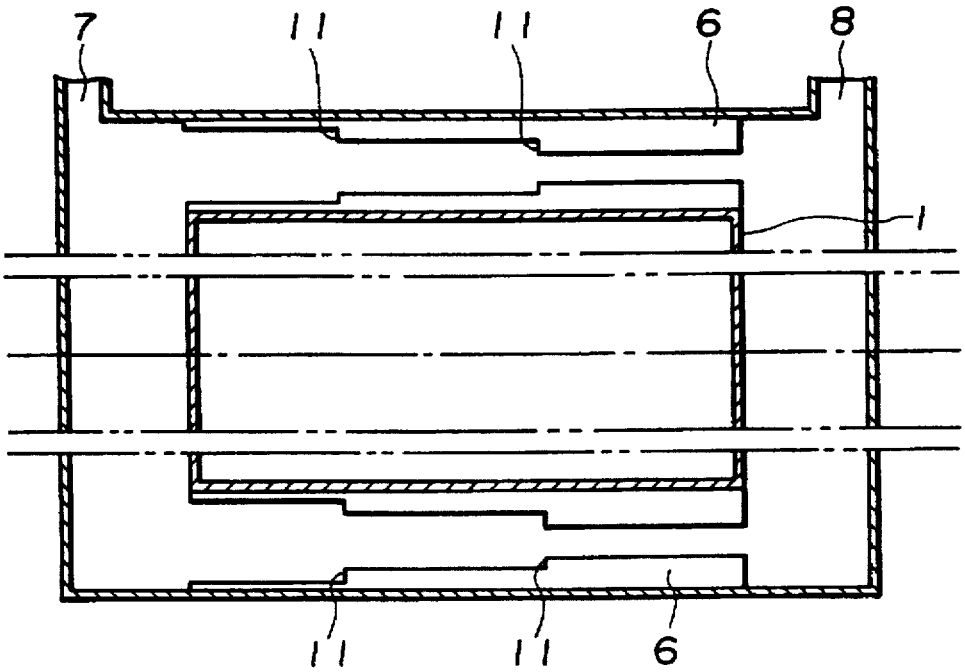
FIG. 4 is a schematic cross sectional view for an embodiment of an impact pulverizer having a stepped rotor and a stepped stator.

FIG. 3 is a schematical, vertical cross sectional view of the impact pulverizer in which the rotor 1 and the stator 6 are continuously tapered such that they increase their thickness from the feed opening 7 to the discharge opening 8 (tapered rotor and stator). On the other hand, FIG. 4 shows a rotor and a stator each having two or more steps, in which each of the rotor 1 and the stator 6 has the thickness increased stepwise from the feed opening 7 to the discharge opening 8.

Accordingly, the present invention also provides an impact pulverizer comprising a feed opening for a material to be pulverized, a pulverizing section formed between an outer surface of a rotor and an inner surface of a stator and a discharge opening, each of the outer surface and the inner surface having ridges of a triangular waveform, and a gap between the ridges of the rotor and of the stator in the pulverizing section on the side of the discharge opening being smaller than that between the ridges of the rotor and of the stator in the pulverizing section on the side of the feed opening.

Use of the impact pulverizer can provide an effect of transporting a crushed toner material supplied from the feed opening to pulverizing sections of gradually decreased gap and capable of conducting efficient pulverization. Particularly, use of the impact pulverizer having the stepped rotor and the stepped stator as shown in FIG. 4 provides an advantageous effect, in addition to the effect described above, of rebounding coarse particles and pulverizing them repeatingly, thereby producing a pulverized toner material having a sharp particle size distribution.

As the impact pulverizer used in this embodiment, an impact pulverizer in which only one of the stator and the rotor is tapered or stepped can also be used suitably in addition to the impact pulverizer having the pulverizing section as shown in FIG. 3 and FIG. 4. Further, a combination of a tapered stator and a stepped rotor or a tapered rotor and a stepped stator may also be used.

The gap (X) in the upstream portion of the pulverizing section (a portion of the pulverizing section with a larger gap) and a gap (Y) in the downstream portion of the pulverizing section (a portion of the pulverizing section with a smaller gap) can be selected properly depending on the particle diameter of the supplied material to be pulverized and a desired particle diameter of the pulverizate. X is preferably from 0.3 mm to 3 mm, more preferably, from 0.5 mm to 2.5 mm, while Y is preferably from 0.1 mm to 2.5 mm and more preferably, 0.2 to 2 mm. The X to Y ratio is preferably as: $1<(X/Y)\leqq 10$.

In the above, the term "gap" means a distance between the top of the ridge of the rotor and the top of the ridge of the stator.

The method for producing the toner in this embodiment may include a step of separation by disposing a classifying means before supplying the crushed toner material to an impact pulverizer or by disposing a classifying means between a pulverizing section with a large gap and a pulverizing section with a small gap. Further, in a case of serially connecting three or more impact pulverizers, or in a case of disposing three or more-stepped stators, there is no particular restriction on the gap in the pulverizing section at or after the third stage and this can be properly selected depending on the pulverizing conditions and, preferably, it is efficient to make the gap smaller than the gap in the pulverizing section at the second stage.

According to the present invention, there can be provided a method for producing a toner for electrostatic charge development causing less fogging (a phenomenon in which black spots are formed in the white area of images) and providing a satisfactory image quality that causes less over-pulverized toner, which shows satisfactory productivity and is economically advantageous. The present invention is of a significant industrial value.

EXAMPLE

Description will now be made more in details to the present invention referring to examples but it should be noted that the present invention is not limited to the following examples unless it exceeds the scope of the present invention.

Example 1

One hundred (100) parts by weight of a styrene-acrylate copolymer (softening point: 145° C., glass transition point: 64° C.), 6 parts by weight of carbon black ("MA 100", Mitsubishi Kasei Co.), one part by weight of a low molecular weight polypropylene ("VISCOLE 55OP", Sanyo Kasei Co.), and 2 parts by weight of a charge controlling agent ("BONTRON P5111: quaternary ammonium salt, Orient Chemical Co.) were blended, kneaded in a melt extruder, extruded into a plate-shape on a cooling belt to cool and solidify, to obtain a toner material.

Then, after crushing the toner material by a hammer mill to an weight average particle diameter of about 300 μm, it was supplied at a rate of 150 kg/hr to a horizontal impact pulverizer having a structure as shown in FIG. 1 with a gap of about 2 mm between ridges of a rotor and of a stator, and pulverized under operation conditions at an atmospheric temperature of not more than 50° C. and a circumferential speed of the rotor at 150 m/s.

Then, the toner obtained by pulverizing was classified by a classifier to recover a toner of an average classified diameter of 8.0 μm. The rate of the toner over-pulverized to not more than 4 μm of average classified diameter was 20 wt %. Further, the electric power consumption in the pulverizing and classifying steps were about 2,500 KWH per one ton of the toner.

Four parts by weight of the toner and 100 parts by weight of a carrier using a ferrite powder as a core material were mixed to prepare a developer and an actual copying test was conducted using a copying machine having an organic photoconductor as a light sensitive material. The same toner as that used for the developer was used as a supplementing toner in the actual copying test. As a result of the actual copying test, there was no fogging, the copy density was appropriate and the actual copying quality was satisfactory. In addition, there were no other disadvantages in view of practical use.

Example 2

At first, 100 parts by weight of a styrene-acrylate copolymer (softening point 145° C., glass transition point 64° C.), 5.5 parts by weight of carbon black ("#30", Mitsubishi Kasei Co.), 2 parts by weight of a low molecular weight polypropylene ("VISCOLE 55OP", Sanyo Kasei Co.), and 2 part by weight of a charge controlling agent ("BONTRON P51": quaternary ammonium salt, Orient Chemical Co.) were blended, kneaded in a melt extruder, extruded into a plate-shape on a cooling belt to cool and solidify, to obtain a toner material.

Then, after crushing the toner material by a hammer mill to a weight average particle diameter of about 300 μm, it was supplied at a rate of 200 kg/hr to the same horizontal impact pulverizer as in Example 1 and pulverized under operation conditions at an atmospheric temperature of not more than 50° C. and a circumferential speed of the rotor at 138 m/s.

Then, the toner obtained by pulverizing was classified by a classifier to recover a toner of an average classified diameter of 10.0 μm. The rate of the toner over-pulverized to not more than 6 μm of average classified diameter was 15 wt %. Further, the electric power consumption in the pulverizing and classifying steps were 2,500 KWH per one ton of the toner.

Comparative Example 1

At first, a coarsely crushed toner material of the same composition as in Example 1 was put to medium crushed by an impact crusher and further pulverized finely by an jet pulverizer. An impact crusher in which ridges of a stator were of a rectangular convex shape and ridges of a rotor formed by embedding flat plates ("TURBOMILLT400", Turbo Industry Co.) was used as the impact crusher, and a supersonic jet mill ("I-10", Nippon Pneumatic Industry Co.) was used as the jet pulverizer. Then, the coarsely crushed toner material was supplied at a rate of 50 kg/hr to the impact crusher and medium crushed under conditions at an atmospheric temperature of not more than 50° C. and a circumferential speed of the rotor at 115 m/s.

Then, after pulverizing by the jet pulverizer, the toner obtained by pulverizing was classified by a classifier to recover a toner of an average classified diameter of 10.5 μm. The rate of the toner over-pulverized to not more than an average classified diameter of 6 μm was 40 wt %. Further, the electric power consumption in the pulverizing and classifying steps was 5,000 KWH per one ton of the toner.

Example 3

The following materials were mixed, kneaded and coarsely crushed to obtain a crushed toner material (weight average particle diameter of about 300 μm).

| Styrene-acrylate copolymer resin (softening point: 145° C., glass transition point: 64° C.) | |
|---|---|
| Colorant: carbon black MA100 (Mitsubishi Kasei Co.) | 6 parts |
| Low molecular weight polypropylene VISCOLE 550P (Sanyo Kasei Co.) | 1 part |
| Charge controlling agent: BONTRON P-51, quaternary ammonium salt (Orient Chemical Co.) | 2 parts |

The crushed toner material was supplied at a rate of 60 kg/h and pulverized by using an impact pulverizer at a first stage having a pulverizing section with a gap of 2 mm (TURBOMILL T-400RS, Turbo Industry Co.), under conditions at an atmospheric temperature of not more than 50° C. and a circumferential speed of the rotor at 132 m/s.

Successively, pulverization was carried out by using an impact pulverizer at a second stage (same kind of pulverizer as that at the first stage), under the same conditions as those for the pulverizing at the first stage except for changing the gap of the pulverizing section to 1 mm. Subsequently, the toner obtained by pulverizing was classified by an elbow jet classifier ("EJ-45-3S") to recover a toner of an average classified diameter of 5.0 μm. The rate of over-pulverized toner, overpulverized to not more than 3 μm of average classified diameter, was 30 wt %, which was about ½ of the rate generated by the conventional Jet pulverizer to be described later (Comparative Example 2). Further, the electric power consumed in the pulverizing and classifying steps was about 5,000 kWH per one ton of the toner, which was ⅙ as compared with a case of manufacture by the conventional jet pulverizer.

An actual copying test was conducted by mixing and stirring 4 parts of the toner obtained in this example, and 100 parts of a carrier comprising a ferrite powder as a core material and using a copying machine having an organic photoconductor as a light sensitive material, on the resultant developer. The supplementing toner used for the actual copying test was the same as the toner used in the developer described above.

In this test, images at an extremely high resolution power and high gradation could be obtained, there was no other disadvantages in view of practical use and the resultant toner and developer were of excellent quality.

Example 4

The same crushed toner material as that in Example 3 was supplied at a rate of 60 kg/h to a impact pulverizer ("TURBOMILL T400", Turbo Industry Co.) having a stepped rotor, in which a gap between ridges of the rotor and of a stator in the upstream portion of the pulverizing section was 2 mm and that of the downstream portion of the pulverizing section was 1 mm, and pulverized under operation conditions at an atmospheric temperature of not more than 50° C. and a circumferential speed of the rotor at 132 m/s (in the upstream portion).

Then, the toner obtained by pulverizing was classified by an elbow-jet classifier (Model EJ-45-3S) to recover a toner of an average classified diameter of 5.0 μm. The ratio of the toner over-pulverized to not more than 3 μm of average classified diameter was 35 wt %, which was about two-thirds of that (55 wt %) when a conventional jet pulverizer as described below was used. Further, the electric power consumption in the pulverizing and classifying steps were about 5,000 kWH per ton of the toner, which was about one-sixth of that when the conventional jet pulverizer was used.

The obtained toner was sieved with a sieve of 325 mesh to determine the amount of large particles left on the sieve, which were incidentally mixed into the toner at classification. The amount of large particles was not more than 0.0005 wt % based on the toner.

The actual copying test was conducted by the same procedure as in Example 3. Unfavorable phenomena due to mixing of large particles such as black spots, white spots, and white thin lines were not observed. The images with an extremely high resolution power and high gradation could be obtained. There were no other disadvantages in view of practical use and the resultant toner and developer were of excellent quality.

Comparative Example 2

From the same crushed toner material as that in Example 3, a toner of an average classified diameter about 5.0 μm was obtained by using a jet pulverizer (Jet Mill I-10, Nippon Pneumatic Industry Co.). Under the pulverizing conditions, the yield was poor as the rate of the over-pulverized toner, over-pulverized to not more than 3 μm of average classified diameter, was 55 wt %. Further, the necessary amount of electric power per one ton of the toner was as high as 30,000 kWH, and the energy efficiency worsened.

The amount of large particles was determined by the same procedure as in Example 4. The amount was 0.0047 wt % based on the toner, which was about ten times that in the toner of Example 4.

The actual copying test was conducted in the same procedure as in Example 3. Unfavorable phenomena due to mixing of large particles such as black spots, white spots, and white thin lines were observed, and there were disadvantages in view of practical use.

In all of the above Examples 1 to 4, the used pulverizer had a stator and a rotor which had ridges of a triangular waveform in which the top end of each ridge was truncated to have a flat face (width: 0.5 mm), the bottom of the concave between the ridges had a circular shape (radius: 1.1 to 1.2 mm), the distance from the top end of the convex to the bottom of the concave was 2 mm, and the ridge pitch was 2.5 ridges/cm.

What is claimed as new and desired to be secured by Letters Patent of the United States:

1. A method for producing a toner for electrostatic development, comprising kneading a mixture of starting toner materials comprising at least a resin and a colorant, extruding the mixture, cooling to obtain a toner material, crushing the toner material and then pulverizing the crushed toner material by an impact pulverizer having a pulverizing section formed by disposing a stator having ridges of a triangular waveform at an inner surface thereof and a rotor having ridges of a triangular waveform at an outer surface thereof and each bottom of concaves between the ridges is round at a gap from 1.1 to 3 mm between the ridges of the stator and of the rotor.

2. A method according to claim 1, wherein a circumferential speed of the rotor is from 100 to 200 m/s.

3. A method according to claim 1, wherein a weight average particle diameter of the crushed toner material is from 100 to 1000 μm.

4. A method according to claim 1, further comprising a classifying step subsequent to the pulverizing step.

5. A method according to claim 1, wherein the pulverizing section comprises an upstream portion on a material-feeding side and a downstream portion on a material discharging side, and the pulverizing is first carried out in the upstream portion of the pulverizing section and subsequently in the downstream portion of the pulverizing section having a gap between the ridges of the stator and of the rotor which is smaller than that of the upstream pulverizing section.

6. A method according to claim 5, wherein a gap (X) in the upstream portion of the pulverizing section and a gap (Y) in the downstream portion of the pulverizing section satisfy the following relations:

$0.3\ \text{mm} \leqq X \leqq 3\ \text{mm}$ $0.1\ \text{mm} \leqq Y \leqq 2.5\ \text{mm}$ $1 < (X/Y) \leqq 10.$ 7. A method according to claim 1, wherein each top end of the ridges is blunt.

8. A method according to claim 7, wherein the top end has a flat face.

9. A method according to claim 1, wherein each top end of the ridges is sharp.

10. A method according to claim 1, wherein the bottom has a rounded shape which is a part of circle.

11. The method according to claim 1 wherein a weight average particle diameter of the toner obtained by pulverizing is from 2 to 15 μm.

* * * * *

UNITED STATES PATENT AND TRADEMARK OFFICE

CERTIFICATE OF CORRECTION

PATENT NO. : 5,637,434

DATED : June 10, 1997

INVENTOR(S) : Susumi IKUSHIMA, et al.

It is certified that error appears in the above-indentified patent and that said Letters Patent is hereby corrected as shown below:

On the title page, item [30], the Foreign Application Priority Data should be:

[30]

--Dec. 21, 1992 [JP] Japan ..... 4-356317
Mar. 15, 1993 [JP] Japan ..... 5-54097--

Signed and Sealed this

Ninth Day of September, 1997

Attest:

Bruce Lehman

BRUCE LEHMAN

Attesting Officer

Commissioner of Patents and Trademarks